United States Patent [19]

Graboyes

[11] 4,397,095

[45] Aug. 9, 1983

[54] REGISTRATION AND TRANSFER LOCKING UNIT FOR A STEEL RULE DIE AND ACCOMMODATING COUNTER PLATE

[75] Inventor: Herman A. Graboyes, Mishawaka, Ind.

[73] Assignee: Atlas Steel Rule Die, Inc., Elkhart, Ind.

[21] Appl. No.: 252,627

[22] Filed: Apr. 9, 1981

[51] Int. Cl.[3] ..... B26D 5/08

[52] U.S. Cl. ..... 33/181 R; 83/635; 308/4 C

[58] Field of Search ..... 33/181 R, 185 R; 308/4 C; 83/635, 637

[56] References Cited

U.S. PATENT DOCUMENTS

| | | | |
|---|---|---|---|
| 1,568,017 | 12/1925 | Danly | 83/637 |
| 1,980,174 | 11/1934 | Baumbach | 33/181 R |
| 2,426,124 | 8/1947 | Skwierawski | 33/185 R |
| 2,652,893 | 9/1953 | Janiszewski | 308/4 C |
| 2,774,430 | 12/1956 | Blazek | 308/4 C |
| 3,279,870 | 10/1966 | Janiszewski | 308/4 C |
| 3,297,015 | 1/1967 | Crawford | 83/637 |
| 3,402,623 | 9/1968 | Bennett | 83/637 |
| 3,776,086 | 12/1973 | Janiszewski | 308/4 C |
| 4,004,448 | 1/1977 | von Holdt | 83/637 |

*Primary Examiner*—Richard R. Stearns
*Attorney, Agent, or Firm*—James D. Hall

[57] ABSTRACT

A die and accommodating counter assembly for scoring and cutting sheet material in which cooperating bushing and pin registration and transfer locking units are utilized to maintain the alignment of the die and the counterplate when being placed within a press.

5 Claims, 4 Drawing Figures

REGISTRATION AND TRANSFER LOCKING UNIT FOR A STEEL RULE DIE AND ACCOMMODATING COUNTER PLATE

SUMMARY OF THE INVENTION

This invention relates to a combination die and counterplate assembly for scoring and cutting sheet material and will have specific application to a locking unit utilized to maintain the die and the counterplate in precise alignment when being transferred to and placed within a press.

Once a die and counterplate have been assembled and the scoring rules and cutting knives of the die aligned with accommodating grooves and lands on the counterplate, it is necessary to secure the die and the counterplate against relative movement to maintain the alignment of the die and the counterplate until inserted into and secured within a press. In this invention, the maintenance of alignment between the die and counterplate is accomplished by bushings and guide pins which allow for slight relative movement of the die toward and away from the counterplate with the scoring rules and cutting knives of the die maintaining their aligned relationship with the counterplate.

Accordingly, it is an object of this invention to provide an accurate means for securing a die and counterplate in an opposed face-to-face manner and in a precise aligned relationship for transfer to a press.

Another object of this invention is to provide a die and accommodating counterplate assembly which is used for scoring and cutting sheet material and which includes a registration and transfer locking sub-assembly by which the aligned relationship between the die and the counterplate is maintained for securement within a press.

Still another object of this invention is to provide a registration and transfer locking unit between a steel rule die and accommodating counterplate by which aligned movement between the die and counterplate can be accommodated by the locking unit.

Other objects of this invention will become apparent upon a reading of the following description.

BRIEF DESCRIPTION OF THE DRAWINGS

A preferred embodiment of this invention has been chosen for purposes of illustration and description wherein.

DESCRIPTION OF THE PREFERRED EMBODIMENT

The preferred embodiment illustrated is not intended to be exhaustive or to limit the invention's precise form disclosed. It is chosen and described to best explain the principles of the invention and its application in practical use to thereby enable others skilled in the art to best utilize the invention.

Figures 1, 1A:
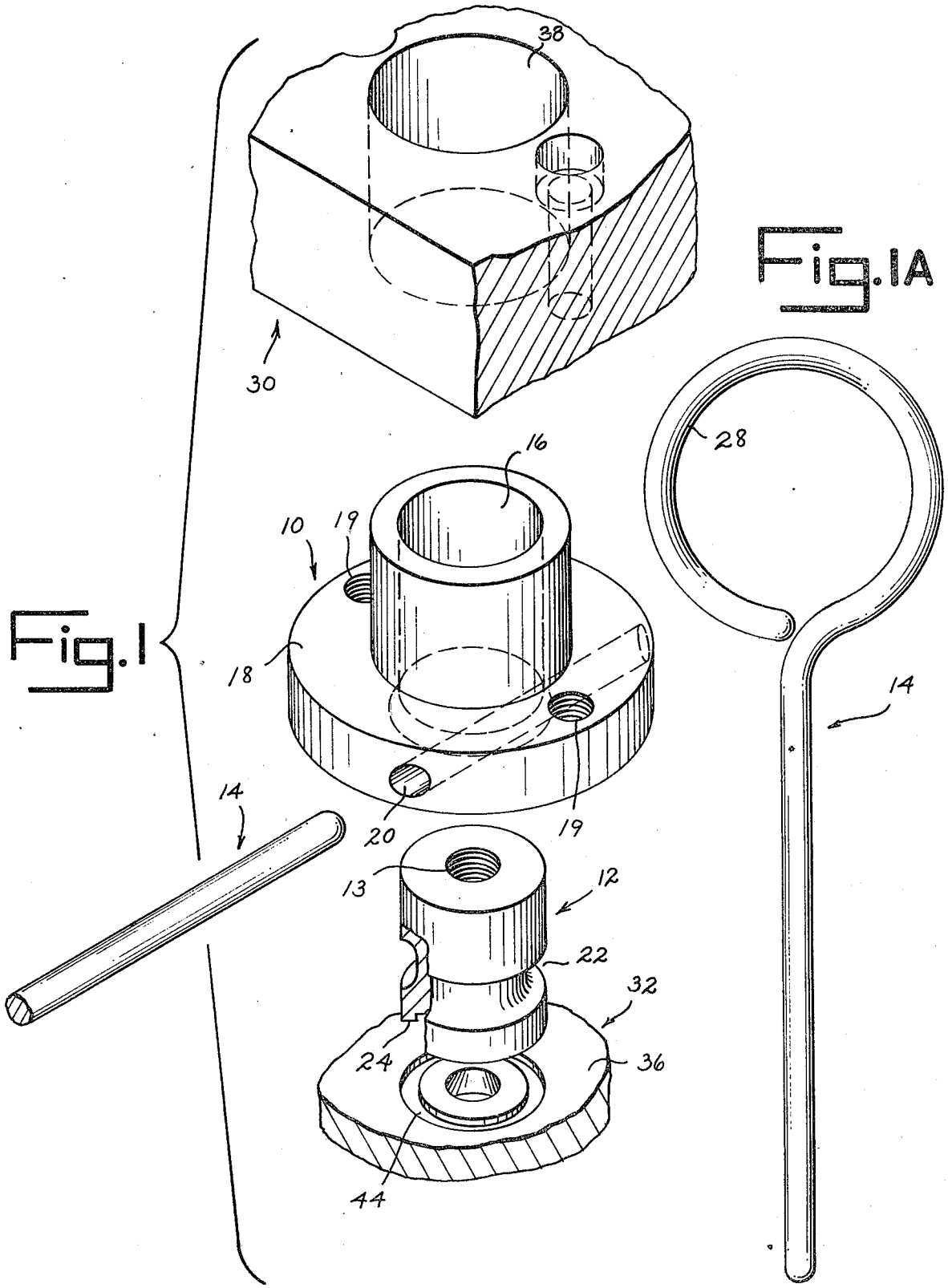
FIG. 1 is an exploded view of the bushing, guide pin, and removable lock pin of the register and transfer locking unit of this invention, showing the guide pin and lock pin in fragmented form for purposes of illustration.
FIG. 1A is a full view of the lock pin.

The registration and transfer locking unit of this invention includes, as shown in FIG. 1, a bushing 10, a guide pin 12, and a locking or retainer pin 14. Bushing 10 has a longitudinal bore 16 through it and includes an outturned flange 18 at one end. A transverse bore 20 is formed in bushing 10 through its flange 18 intersecting the longitudinal bore 16 within the bushing. Guide pin 12 has an annular groove 22 formed about its sidewall, and, preferably, includes an annular rib 24 which projects from end face 26 of the pin. Locking pin 14 is formed into a ring 28 at one end to facilitate insertion and removal from the locking unit.

In the preferred embodiment, bushing 10 is secured to the die 30 and pin 12 is secured to the counterplate 32 of a scoring and cutting assembly for sheet material, usually of a paper composition. Die 30 will carry either or both scoring rules and cutting knives (not shown) which are aligned with grooves and land portions on the counterplate 32 with the die and counterplate being utilized to cut and score sheet material inserted between opposing faces 34 and 36 of the die and counterplate respectively. The construction of die 30 and counterplate 32 can vary from construction to construction of the assembly. After the die and counterplate have been assembled and the scoring rules and cutting knives are aligned with respect to the counterplate, bushing 10 and guide pin 12 units are utilized to secure the die and counterplate in such an aligned position during transfer to and securement within a press or cutting module. The number of bushings 10 and guide pins 12 needed to secure die 30 and counterplate 32 can vary depending upon the size of the die and counterplate with normally four sets or units of bushings and interfitting guide pins being utilized.

Figure 2:
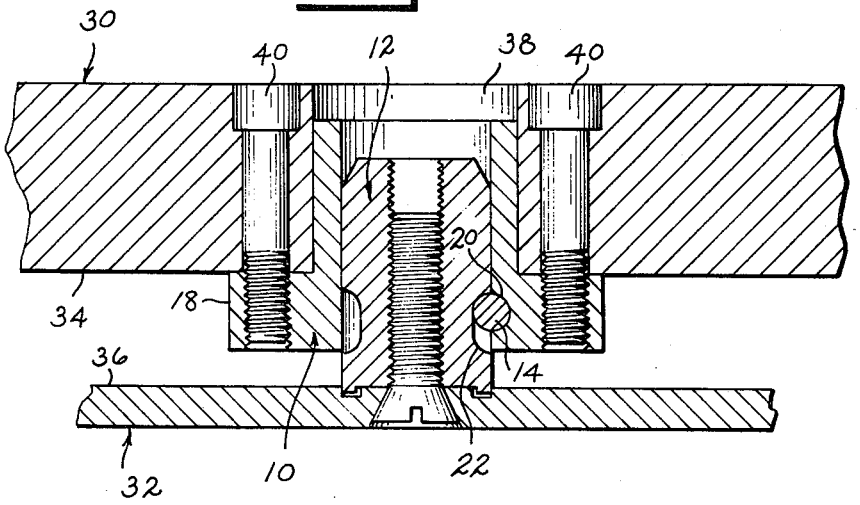
FIG. 2 is a fragmentary sectional view of the die and counterplate showing the registration and transfer locking unit of this invention in one securing position.
Figure 3:
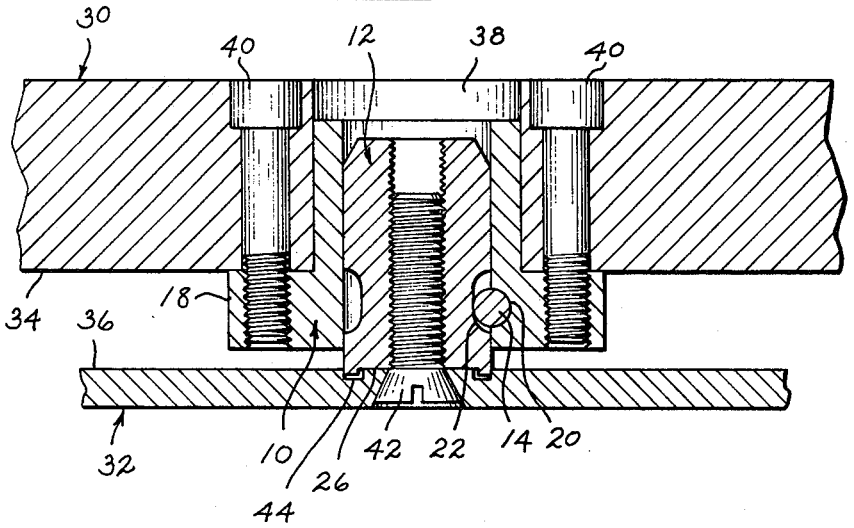
FIG. 3 is a fragmentary sectional view of the die and counterplate having the registration and transfer locking unit of this invention shown in a second securing position.

A bore 38 is machined die 30 for each bushing 10. A bushing 10 is fitted snuggly within each bore 38 and secured by screws 40 with its flange 18 in contact with face 34 of the die. Screws 40 extend through die 30 and into threaded holes 19 in bushing flange 18. Each guide pin 12 is secured to counterplate 32 by means of a screw 42 which extends through the counterplate and is concentrically threaded into a tapped bore 13 in the guide pin. To accurately position and align each pin 12 upon counterplate 32, an annular groove 44 is formed in face 36 of the counterplate to receive the annular rib 24 of the guide pin as end face 26 of the pin rests upon the counterplate face. With each guide pin 12 fitting snuggly into its accommodating bushing 10, groove 22 in the pin will align itself with transverse bore 20 in flange 18 of the bushing. A locking pin 14 is then inserted through the aligned groove 22 and transverse bore 20 in each interfitting pin 12 and bushing 10 to secure pin 12 within the bushing as illustrated in FIGS. 2 and 3.

The width of groove 22 in each guide pin 12 exceeds the diametrical or transverse dimension of locking pin 14 so as to allow longitudinal relative movement of the guide pin within the bushing and, therefore, allow the spacing between opposing faces 34 and 36 of die 30 and counterplate 32 to vary as illustrated in the figures. Once die 30 and counterplate 32 have been inserted into the press, with the die being permanently secured and the counterplate being temporarily secured to the counter base of the press, such as by an adhesive, and the press being actuated into its impression position, each locking pin is removed, thereby allowing for the separation of each guide pin from its accommodating bushing when the press is full opened. The counterplate is then drilled for pinning to the counter base of the press and guide pins 12 removed with the counterplate being repositioned for pinning in a properly aligned relationship with respect to the die and secured to the press.

By designing each cooperating bushing 10 and guide pin 12 so as to accommodate a limited relative movement of the guide pin within the bushing, the press within which the connected die and counterplate are inserted can be cycled or actuated into its impression position to firmly set the counterplate into its temporarily fixed position relative to the press counter base in preparation for drilling to receive pins and locator blocks for its permanent press installation while maintaining its precise alignment with the die.

It is to be understood that the invention is not to be limited to the details above given but may be modified within the scope of the appended claims.

What I claim is:

1. In a combination die and an accommodating counterplate assembly for scoring and cutting sheet material located therebetween, means for securing said die over said counterplate in an opposed face-to-face manner and in a precise aligned relationship for transfer to a press where said scoring and cutting of sheet material can occur, the improvement wherein said die and counterplate securing means includes a bushing having a longitudinal bore and a guide pin adapted to fit snuggly into said bushing longitudinal bore, an opening formed in one of said die and counterplate, said bushing fitted into said opening and secured to said one of the die and counterplate, said bushing including an end portion extending beyond the opposing face of said one of the die and counterplate, said bushing end portion having a transverse bore therethrough intersecting its longitudinal bore, said guide pin secured to the other of said die and counterplate, said guide pin protruding from the opposing face of said other of the die and counterplate and having a side wall with a groove therein said guide pin fitting into said bushing longitudinal bore when said die and counterplate are in their aligned relationship with said guide pin groove registering with said bushing transverse bore, a removable lock pin means fitable into said registering guide pin groove and bushing transverse bore for securing said guide pin within said bushing, said guide pin groove having a width exceeding the transverse dimension of said lock pin means to permit limited relative longitudinal movement of the guide pin within the bushing to allow aligned movement of the die relative to the counterplate.

2. The die and counterplate assembly of claim 1 wherein said guide pin groove extends annularly about the guide pin sidewall.

3. The die and counterplate assembly of claim 2 wherein said die and counterplate securing means includes at least three sets of said bushing and interfitting guide pin.

4. The die and counterplate assembly of claim 1 wherein said end portion includes a flange overlying said bushing opposing face of said one of the die and counterplate.

5. The die and counterplate assembly of claim 4 wherein said guide pin includes a base end face and an annular rib extending from said end face, the opposed face of said other of the die and counterplate including an annular groove, said guide pin rib fitting into said annular groove.

* * * * *